US007854808B2

(12) United States Patent
Murakami et al.

(10) Patent No.: US 7,854,808 B2
(45) Date of Patent: Dec. 21, 2010

(54) STEEL SHEET FOR VITREOUS ENAMELING AND PRODUCTION METHOD

(75) Inventors: Hidekuni Murakami, Kitakyusha (JP); Satoshi Nishimura, Kitakyusha (JP)

(73) Assignee: Nippon Steel Corporation, Tokyo (JP)

( * ) Notice: Subject to any disclaimer, the term of this patent is extended or adjusted under 35 U.S.C. 154(b) by 290 days.

(21) Appl. No.: 10/517,502

(22) PCT Filed: Mar. 6, 2003

(86) PCT No.: PCT/JP03/02672

§ 371 (c)(1),
(2), (4) Date: Dec. 10, 2004

(87) PCT Pub. No.: WO03/106726

PCT Pub. Date: Dec. 24, 2003

(65) Prior Publication Data

US 2005/0236078 A1 Oct. 27, 2005

(30) Foreign Application Priority Data

Jun. 12, 2002 (JP) ..... 2002-170926

(51) Int. Cl.
*C22C 38/04* (2006.01)
*C21D 7/13* (2006.01)

(52) U.S. Cl. ..... 148/333; 148/320; 148/653; 148/654

(58) Field of Classification Search ..... 148/330, 148/320, 333, 653, 654; 420/121, 128
See application file for complete search history.

(56) References Cited

FOREIGN PATENT DOCUMENTS

| | | | |
|---|---|---|---|
| EP | 1 096 030 A | | 5/2001 |
| EP | 1 111 081 A | | 6/2001 |
| EP | 1 136 579 A | | 9/2001 |
| EP | 1 172 451 A | | 1/2002 |
| EP | 1 225 241 A | | 7/2002 |
| JP | 06-122938 | | 5/1994 |
| JP | 08-027522 | | 1/1996 |
| JP | 10-102222 | | 4/1998 |
| JP | 2002-80934 | * | 3/2002 |
| WO | WO 01 98551 A | | 12/2001 |

OTHER PUBLICATIONS

Computer-generated English translation of Japanese patent 2002-080934, Murakami, Hidekuni et al, Mar. 22, 2002.*
English abstract of Japanese patent 360100686, Kenji Ito et al., Jun. 4, 1985.*
Derwent publication of English abstract of Japanese patent 73029289, Aug. 19, 1970.*

* cited by examiner

*Primary Examiner*—Deborah Yee
(74) *Attorney, Agent, or Firm*—Kenyon & Kenyon LLP

(57) ABSTRACT

To provide a non-aging steel sheet for vitreous enameling, the steel sheet being excellent in resistance to bubbles and black spots, without the employment of decarbonization and denitrification annealing that raises the cost of production and also without the addition of expensive elements such as Nb, Ti, etc. that raise the cost of alloys. The steel sheet comprises, in mass, to C: 0.0050% or less, Si: 0.50% or less, Mn: 0.005 to 1.0%, P: 10×(B−11/14×N) to 0.10%, S: 0.080% or less, Al: 0.050% or less, N: 0.0005 to 0.020%, B: 0.60×N to 0.020%, and O: 0.002 to 0.0800%, and the shape of B nitrides is controlled mainly by adjusting hot-rolling conditions.

5 Claims, No Drawings

STEEL SHEET FOR VITREOUS ENAMELING AND PRODUCTION METHOD

TECHNICAL FIELD

The present invention relates to a steel sheet for vitreous enameling, the steel sheet being excellent in enameling properties, workability and aging properties, and a method for producing the steel sheet at a low cost.

BACKGROUND ART

A steel sheet for vitreous enameling was conventionally produced by applying an annealing treatment for decarbonization and denitrification and lowering C and N contained therein to several tens of ppm or less. However, such an annealing treatment for decarbonization and denitrification had the drawbacks of low productivity and a high production cost. As a technology for avoiding an annealing treatment for decarbonization and denitrification, Japanese Unexamined Patent Publication No. H6-122938 discloses a steel sheet for vitreous enameling, the steel sheet being produced from ultra-low carbon steel obtained by lowering the C content to several tens of ppm through degassing in a steelmaking process. In such a technology, drawability and aging resistance are improved by adding Ti, Nb, etc. to avoid the adverse effects of solute C or solute N that still remains slightly in a steel sheet. However, the problems of the technology are that the defects such as bubbles and black spots are likely to be caused by carbides and nitrides and the production cost increases due to the addition of Ti, Nb, etc.

As technologies of solving the problems, steel sheets for vitreous enameling, wherein the addition amounts of Ti, Nb, etc. are decreased, though drawability deteriorates to some extent, and methods for producing the steel sheets have been invented and are disclosed in Japanese Unexamined Patent Publication Nos. H8-27522 and H10-102222 and other publications. These technologies are ones wherein B is used predominantly for fixing N. However, the problems of the aforementioned disclosed technologies are: that aging properties deteriorate and thus formability in pressing is impaired since the lowering of solute C is insufficient sometimes depending on the production conditions and N increases caused by the re-melting of nitrides during annealing; and that the defects such as bubbles and black spots are likely to be caused by the gases generated by the decomposition of nitrides and the like during the baking of a vitreous enamel.

The object of the present invention is to overcome the above-mentioned problems of a conventional steel sheet for vitreous enameling, to provide a non-aging and low-cost steel sheet for vitreous enameling, the steel sheet being excellent in resistance to bubbles and black spots, and to provide a method for producing the steel sheet.

DISCLOSURE OF THE INVENTION

The gist of the present invention is as follows:

(1) A steel sheet for vitreous enameling excellent in workability, aging properties and enameling properties, said steel sheet containing, in mass, C: 0.0050% or less,
Si: 0.50% or less,
Mn: 0.005 to 1.0%,
P: 10×(B−11/14×N) to 0.10%,
S: 0.080% or less,
Al: 0.050% or less,
N: 0.0005 to 0.020%, B: 0.60×N to 0.020%, and
O: 0.002 to 0.0800%.

(2) A steel sheet for vitreous enameling excellent in workability, aging properties and enameling properties, said steel sheet containing, in mass, C: 0.0025% or less,
Si: 0.050% or less,
Mn: 0.10 to 0.50%,
P: 10×(B−11/14×N) to 0.030%,
S: 0.030% or less,
Al: 0.010% or less,
N: 0.0035 to 0.0060%,
B: 0.60×N to 0.0060%, and
O: 0.005 to 0.0450%.

(3) A steel sheet for vitreous enameling excellent in workability, aging properties and enameling properties, said steel sheet containing, in mass, C: 0.0025% or less,
Si: 0.050% or less,
Mn: 0.10 to 0.50%,
P: 10×(B−11/14×N) to 0.030%,
S: 0.030% or less,
Al: 0.010% or less,
N: 0.0005 to 0.0033%,
B: 0.60×N to 0.90×N %, and
O: 0.005 to 0.0450%.

(4) A steel sheet for vitreous enameling excellent in workability, aging properties and enameling properties according to any one of the items (1) to (3), said steel sheet further containing one or more of Nb, V, Ti, Ni, Cr, Se, As, Ta, W, Mo and Sn at 0.030 mass percent or less in total.

(5) A steel sheet for vitreous enameling excellent in workability, aging properties and enameling properties according to any one of the items (1) to (4), said steel sheet satisfying the following expression:

$$(\text{the amount of N existing as BN})/(\text{the amount of N existing as AlN}) \geqq 10.0.$$

(6) A steel sheet for vitreous enameling excellent in workability, aging properties and enameling properties according to any one of the items (1) to (5), said steel sheet satisfying the following expression:

$$(\text{the amount of N existing as BN})/(\text{N content}) \geqq 0.50.$$

(7) A steel sheet for vitreous enameling excellent in workability, aging properties and enameling properties according to any one of the items (1) to (6), wherein, with regard to simple or compound nitrides, that contain B or Al and are 0.02 to 0.50 μm in diameter:

the average diameter of said nitrides is 0.080 μm or larger; and the proportion of the number of the nitrides 0.050 μm or smaller in diameter to the total number of said nitrides is 10% or less.

(8) A method for producing a steel sheet for vitreous enameling excellent in workability, aging properties and enameling properties, characterized by:

retaining a slab containing the components according to any one of the items (1) to (4) in the temperature range from 900 to 1,100° C. (Retained Temperature Range 1) for 300 min. or longer before commencing hot rolling;

thereafter retaining it in a temperature range not less than 50° C. higher than said retained temperature (Retained Temperature Range 2) for 10 to 30 min.;

then cooling it to a temperature range not less than 50° C. lower than said retained temperature (Retained Temperature Range 3) at a cooling rate of 2° C./sec. or less;

retaining it in Retained Temperature Range 3 for 10 min. or longer; and thereafter commencing hot rolling.

(9) A method for producing a steel sheet for vitreous enameling excellent in workability, aging properties and enameling properties according to the item (8), characterized by further controlling the time period from the time when the coiling of a hot-rolled steel sheet terminates at a temperature of 700 to 750° C. in a hot-rolling process to the time when the temperature of said steel sheet reaches 550° C. or lower to 20 min. or longer.

(10) A method for producing a steel sheet for vitreous enameling excellent in workability, aging properties and enameling properties according to the item (8) or (9), characterized by:

commencing hot rolling;

after the reduction ratio reaches 50% or more, retaining the hot-rolled material in the temperature range from 900 to 1,200° C. for 2 min. or longer with the temperature of said material not lowered to 900° C. or lower; and thereafter commencing the hot rolling again.

BEST MODE FOR CARRYING OUT THE INVENTION

The present invention is hereafter described in detail. In the first place, the chemical composition of a steel is explained in detail.

It is known that, in steel, the lower the C content is, the better the workability is. In the present invention, it is necessary to control C content to 0.0050% or less in order to secure a good aging resistance, a good workability and good enameling properties. The preferable range of C content is 0.0025% or less. Though it is not necessary to specify the lower limit of C content, the practical lower limit thereof is 0.0005%, as a further reduction of the C content increases the cost of steelmaking.

Si is not required to be added intentionally and should be as low as possible as Si deteriorates enameling properties. In the present invention, as the deterioration of enameling properties is insignificant even with a comparatively high Si content, the upper limit of Si content is set at 0.50%. A preferable Si content is 0.050% or less, similarly to the case of a usual steel sheet for vitreous enameling, and a yet more preferable Si content is 0.010% or less.

Mn is a component that influences enameling properties in combination with the amounts of oxygen and S. Mn is also an element which prevents hot shortness caused by S during hot rolling and, in a steel of the present invention, the steel containing a large amount of oxygen, Mn content is required to be 0.005% or more. On the other hand, when the content of Mn is high, enamel adhesiveness is adversely affected and bubbles and black spots are likely to occur and, therefore, the upper limit is determined to be 1.0%, preferably 0.1 to 0.5%.

P, when its content is low, coarsens the grain sizes of crystals and deteriorates aging properties, but the lower limit of the content is determined in relation to the contents of B and N. On the other hand, when P content exceeds 0.10%, P not only hardens a material and deteriorates press workability but also accelerates the rate of pickling during a post-treatment for enameling and increases smuts that cause bubbles and black spots. Therefore, in the present invention, it is specified that the P content is in the range from $10\times(B-11/14\times N)$ to 0.10%, preferably from $10\times(B-11/14\times N)$ to 0.030%.

S increases the amount of smuts in pickling during a post-treatment for enameling and makes bubbles and black spots tend to occur. Therefore, the content of S is set at 0.080% or less, preferably 0.030% or less.

Al, when too much is contained, makes it impossible to control the amount of O in steel within a regulated range. Further, in the control of nitrides too, Al nitrides generate gases by the reaction with water during the baking of vitreous enamel and tend to cause bubble defects, and therefore, Al is not desirable. For those reasons, the content of Al is restricted to 0.050% or less, preferably 0.010% or less.

N is an important element for controlling the state of BN in the present invention. It is preferable that the content of N is as low as possible from the viewpoint of aging properties and resistance to bubbles and black spots. However, when the content is less than 0.0005%, good properties can be obtained even without the B addition that is a requirement in the present invention. Therefore, N content in the present invention is set at 0.0005% or more. The upper limit of N is determined to be 0.020% in relation to B content that is determined based on the relationship with oxygen amount in steel. A preferable upper limit is 0.0050%. Note that, in order to control nitrides to a desirable shape, it is preferable that N content is 0.0035 to 0.0060%, more preferably 0.0005 to 0.0033%.

B is also an important element for controlling the state of BN in the present invention. Though it is preferable to contain B as much as possible in order to control BN in a good state, when it is intended to add B abundantly, the yield in a steelmaking process tends to deteriorate in the case of a steel according to the present invention that contains O abundantly. Therefore, the upper limit of B content is set at 0.020%, preferably 0.0060% or 0.90 times the N content. The lower limit thereof is set at 0.60 times the N content.

O has a direct influence on fish scale resistance. It also affects enamel adhesiveness and resistance to bubbles and black spots in combination with the content of Mn. O content of 0.002% or more is necessary to exhibit such effects. On the other hand, a high O content makes the yield of B addition during steelmaking low, makes a good state of B nitrides difficult to maintain, and deteriorates workability, aging properties and resistance to bubbles and black spots. For these reasons, the upper limit of O content is determined to be 0.0800%. Therefore, the content of O is set at 0.002 to 0.0800%, preferably 0.005 to 0.0450%.

An important condition of the present invention is the control of the kind and amount of B nitrides and a steel according to the present invention should satisfy one of the following expressions:

(the amount of N existing as BN)/(the amount of N existing as AlN)≧10.0, and (the amount of N existing as BN)/(N content)≧0.50, preferably, (the amount of N existing as BN)/(the amount of N existing as AlN)≧20.0, and (the amount of N existing as BN)/(N content)≧0.70.

The reason is not clear yet, but it is estimated that, fixing N as nitrides, particularly as stable B nitrides that are thought to be hardly decomposable during annealing or during the baking of vitreous enamel, is effective in securing aging resistance and resistance to bubbles and black spots. Here, (the amount of N existing as BN) and (the amount of N existing as AlN) are the values obtained by analyzing B and Al amounts in a residue when a steel sheet is dissolved in an iodine alcohol solution and then calculating N amounts regarding the whole B and Al amounts as constituents of BN and AlN, respectively.

The distribution of the sizes of nitrides is also an important factor for improving aging resistance and resistance to bubbles and black spots. With regard to simple or compound nitrides, that contain B or Al, 0.02 to 0.50 μm in diameter, the present invention restricts the average diameter of the nitrides to 0.080 μm or larger and the proportion of the number of the nitrides 0.050 μm or smaller in diameter to the total number of said nitrides to 10% or less. The reason is not clear yet, but it is thought that B nitrides, though they are stable in the state of a high temperature such as in the process of annealing or vitreous enamel baking, are likely to decompose when they are fine and therefore deteriorate aging resistance and resistance to bubbles and black spots. Here, the number and diameter of the precipitates are the values obtained by observing an extraction replica obtained from a steel sheet by the SPEED method using an electron microscope and measuring the number and diameter of the precipitates in a visual field not having deviation. The distribution of the sizes of the precipitates can be obtained by photographing several visual fields and applying image analysis to the photographs. The reason why the diameter of the objective BN is determined to be 0.02 μm or larger is that the quantitative and qualitative analyses of fine precipitates are not said to be perfect even with the latest measurement technology and thus large errors may occur. Further, the reason why the diameter of the objective nitrides is determined to be 0.50 μm or smaller is that, when B, Al or N is contained in large oxides that are contained abundantly in a steel according to the present invention, it may also be measured undesirably and may create errors in the measurement results of the objective nitrides. For those reasons, in the present invention, the range of nitrides is specified in relation to the precipitates having the sizes that allow yet smaller measurement errors to be expected. A precipitate whose shape is elongated is sometimes observed particularly among the precipitates that are compounded with MnS. In such a case, where the shape is not isotropic, the average of the length and breadth is used as the diameter of the precipitate.

It is well known that Cu has the functions of suppressing the rate of pickling during a post-treatment for enameling and of improving adhesiveness. To add Cu by about 0.02% in order to effectuate the functions of Cu in a one-coat enameling treatment does not hinder the effects of the present invention. However, the amounts of solute C and N are very small in case of the present invention, and therefore, when the function of suppressing pickling is excessively strong, the adhesiveness in the duration of low pickling deteriorates. For that reason, the upper limit of Cu content should be restricted to about 0.04% even when Cu is added.

Ti, Nb, V, Ni, Cr, Se, As, Ta, W, Mo and Sn do not hinder the effects of the present invention as long as one or more of them are contained at 0.030% or less in total. In other words, as long as the total content of them is within aforementioned range, it is possible to add them actively, in addition to such an amount thereof as to be unavoidably included from iron ore, scraps and others, with the expectation that the advantages in a production method or in quality, other than the advantages envisaged in the present invention, may be obtained.

Next, the production method is explained hereunder. The effects of the present invention can be obtained under any of the casting methods.

A temperature history during hot rolling largely affects the control of B precipitates as described above. In order to control the value of (the amount of N existing as BN)/(the amount of N existing as AlN) to 10.0 or more, it is desirable, for example: to retain a slab in the temperature range from 900 to 1,100° C. (Retained Temperature Range 1) for 300 min. or longer before commencing hot rolling; thereafter to retain it in a temperature range not less than 50° C. higher than the retained temperature (Retained Temperature Range 2) for 10 to 30 min.; then to cool it to a temperature range not less than 50° C. lower than the retained temperature (Retained Temperature Range 3) at a cooling rate of 2° C./sec. or less; to retain it in Retained Temperature Range 3 for 10 min. or longer; and thereafter to commence hot rolling.

On the other hand, it is also possible to control the state of B precipitates by a temperature history after hot rolling.

In order to control the value of (the amount of N existing as BN)/(N content) to 0.50 or more, it is desirable, for example, to control the time period from the time when the coiling of a hot-rolled steel sheet terminates at a temperature of 700 to 750° C. to the time when the temperature of said steel sheet lowers and reaches 550° C. or lower to 20 min. or longer.

Further, it is possible to optimize the distribution of the sizes of precipitates by controlling a temperature history and a reduction ratio during hot rolling.

In order to satisfy the condition that, with regard to simple or compound nitrides, that contain B or Al, 0.02 to 0.50 μm in diameter: the average diameter of said nitrides is 0.080 μm or larger; and the proportion of the number of the nitrides 0.050 μm or smaller in diameter to the total number of said nitrides is 10% or less, it is desirable, for example: to commence hot rolling; after the reduction ratio reaches 50% or more, to retain the hot-rolled material in the temperature range from 900 to 1,200° C. for 2 min. or longer with the temperature of said material not lowered to 900° C. or lower; and thereafter to commence the hot rolling again.

That is, the object of specifying hot-rolling conditions as explained above is to control the shape of precipitates in a desirable state.

The higher the temperature before the commencement of hot rolling is, the more the precipitates dissolve. Then, as the temperature lowers with the progress of the succeeding hot rolling, the possibility that dissolved elements may precipitate at undesirable element ratios or in undesirable shapes increases.

If the temperature lowers excessively, not only cannot the composition ratio of precipitates be controlled in a preferable state but also the dispersion of precipitate-forming elements during the retention of the temperature is decelerated, and that makes the growth of the precipitates not as expected.

Considering the growth of precipitates during the retention of the temperature in particular, it is necessary to take the influence of not only the temperature but also the time into consideration. The control of a cooling rate is important in order to suppress the fining of the precipitates that are formed as the elements having dissolved during the retention of the temperature precipitate with the drop of the temperature.

It is desirable to strictly control a heat pattern including a heating temperature, a heating time and a cooling rate in order to ideally control precipitates.

Further, with respect to precipitation behavior, a precipitation promotion phenomenon (strain induced precipitation) caused by introducing a strain during the precipitation is well known, and when the strain induced precipitation is applied to a steel according to the resent invention, the composition ratio of the precipitates becomes in a preferable state. The reason is not clear yet, but it is estimated that: a strain caused by the consistency with a parent phase varies with the kind of precipitates; therefore the interaction with the work induced strain also varies with the precipitates; and thus, in a steel according to the present invention, the precipitates preferable to workability and aging properties grow preferentially.

The aforementioned temperature control is applied in the state wherein a parent phase of a steel sheet is predominantly composed of an austenite phase, and the temperature history after a parent phase has transformed into ferrite due to a temperature drop at the latter half stage of a hot-rolling process is also important.

It is thought that the reason is that, in the present invention, though the solubility of the main objective precipitates may decrease with the parent phase transforming from austenite to ferrite and the precipitation may proceed rapidly, stable precipitates vary with the parent phase.

That is, as the precipitates that have been stable up to that time are decomposed and new precipitates that are newly stabilized are formed by the transformation of a parent phase, the composition of the precipitates varies consecutively.

From this viewpoint, the temperature history in a coiling process wherein a steel sheet is retained at a relatively high temperature in a ferrite phase is important.

It is desirable that the cold reduction ratio is 60% or more in order to obtain a steel sheet having a good drawability. When a yet higher drawability is required in particular, it is preferable that the cold reduction ratio is 75% or more.

With respect to annealing, the effects of the present invention do not change with either box annealing or continuous annealing and they are exhibited as long as the temperature is not lower than the recrystallization temperature. From the viewpoint of the cost reduction that is a feature of the present invention in particular, continuous annealing is preferable. A steel according to the present invention is not necessarily annealed at a high temperature since it is characterized by completing recrystallization at 630° C. even with short-time annealing.

Skin-pass rolling is carried out for the purpose of correcting the shape of a steel sheet or suppressing generating yield-point elongation during working. Skin-pass rolling is applied usually at the reduction ratio of about 0.6 to 2% in order to suppress yield point elongation while the deterioration of workability (elongation) due to rolling working is avoided. However, in the present invention, the generation of yield point elongation is suppressed even without the application of skin-pass rolling, and the deterioration of workability is low even with a relatively high reduction ratio in skin-pass rolling. When skin-pass rolling is applied, it is desirable to set the range of the reduction ratio at 5% or lower.

Further, in order to secure enamel adhesiveness, it is preferable, for example, to apply Ni plating of about 0.01 to 2 $g/m^2$ after cold rolling or after annealing.

EXAMPLE

The continuously cast slabs consisting of the various chemical compositions shown in Table 1 were subjected to hot rolling, cold rolling, annealing and skin-pass rolling under the conditions shown in Table 2. The state of nitrides, mechanical properties and enameling properties of the steel sheets are shown in Table 3.

The mechanical properties were evaluated by the tensile tests specified in JIS No. 5 Test. An aging index (AI) was obtained by imposing a prestrain of 10% with a tension and measuring the difference of the stresses between before and after the aging at 100° C. for 60 min.

The enameling properties were evaluated after the process steps shown in Table 4. Among the enameling properties, the surface properties of bubbles and black spots were evaluated by the visual observation under the condition of a long pickling time of 20 min. The enameling adhesiveness was evaluated under the condition of a short pickling time of 3 min. Because the commonly employed P.E.I. adhesiveness test method (ASTM C313-59) was incapable of detecting small difference in the enamel adhesiveness, the enamel adhesiveness was evaluated by dropping a 2.0-kg weight with a spherical head on a test piece from a height of 1 m, measuring the exfoliation state of the enameling film at the deformed area using 169 probing needles, and calculating the percentage of the non-exfoliated area. The fish scale resistance was evaluated by carrying out the accelerated fish scale test, wherein three steel sheets were pre-treated through 3-min. pickling without Ni immersion, glazed with a glaze for direct one-coat enameling, dried, baked for 3 min. in a baking furnace kept at 850° C. and having a dew point of 50° C., and then held for 10 h. in a constant temperature tank kept at 160° C., and by visually judging the occurrence or otherwise of fish scales.

As is clear from the results shown in Table 3, the steel sheets according to the present invention are the steel sheets for vitreous enameling excellent in workability (elongation), aging resistance and enameling properties.

[Tables 1 to 4]

TABLE 1

| | Chemical components (mass %) | | | | | | | | |
|---|---|---|---|---|---|---|---|---|---|
| No. | C | Si | Mn | P | S | Al | N | B | O |
| 1 | 0.0020 | 0.011 | 0.32 | 0.009 | 0.018 | 0.002 | 0.0034 | 0.0023 | 0.041 |
| 2 | 0.0012 | 0.45 | 0.15 | 0.088 | 0.012 | 0.003 | 0.0029 | 0.0020 | 0.035 |
| 3 | 0.0008 | 0.005 | 0.30 | 0.002 | 0.011 | 0.001 | 0.0032 | 0.0025 | 0.062 |
| 4 | 0.0015 | 0.008 | 0.26 | 0.041 | 0.015 | 0.002 | 0.0045 | 0.0070 | 0.026 |
| 5 | 0.0016 | 0.005 | 0.28 | 0.015 | 0.026 | 0.005 | 0.0115 | 0.0075 | 0.033 |
| 6 | 0.0022 | 0.003 | 0.44 | 0.007 | 0.052 | 0.002 | 0.0035 | 0.0033 | 0.044 |
| 7 | 0.0027 | 0.39 | 0.80 | 0.023 | 0.015 | 0.003 | 0.0020 | 0.0024 | 0.008 |
| 8 | 0.0018 | 0.006 | 0.30 | 0.083 | 0.015 | 0.006 | 0.0022 | 0.0034 | 0.010 |
| 9 | 0.0016 | 0.004 | 0.33 | 0.012 | 0.015 | 0.008 | 0.0041 | 0.0028 | 0.007 |
| 10 | 0.0011 | 0.022 | 0.06 | 0.006 | 0.011 | 0.002 | 0.0052 | 0.0039 | 0.039 |
| 11 | 0.0006 | 0.005 | 0.26 | 0.019 | 0.023 | 0.001 | 0.0049 | 0.0055 | 0.024 |
| 12 | 0.0020 | 0.004 | 0.27 | 0.004 | 0.024 | 0.005 | 0.0057 | 0.0041 | 0.011 |
| 13 | 0.0014 | 0.002 | 0.38 | 0.026 | 0.016 | 0.003 | 0.0050 | 0.0040 | 0.034 |
| 14 | 0.0012 | 0.005 | 0.04 | 0.028 | 0.014 | 0.004 | 0.0042 | 0.0057 | 0.036 |
| 15 | 0.0035 | 0.008 | 0.22 | 0.010 | 0.011 | 0.003 | 0.0049 | 0.0033 | 0.029 |
| 16 | 0.0013 | 0.009 | 0.17 | 0.009 | 0.008 | 0.003 | 0.0054 | 0.0034 | 0.035 |
| 17 | 0.0012 | 0.004 | 0.12 | 0.009 | 0.002 | 0.002 | 0.0016 | 0.0013 | 0.022 |
| 18 | 0.0011 | 0.031 | 0.27 | 0.008 | 0.015 | 0.007 | 0.0032 | 0.0027 | 0.015 |

TABLE 1-continued

| No. | Chemical components (mass %) | | | | | | | | |
|---|---|---|---|---|---|---|---|---|---|
| | C | Si | Mn | P | S | Al | N | B | O |
| 19 | 0.0016 | 0.005 | 0.30 | 0.004 | 0.012 | 0.002 | 0.0018 | 0.0013 | 0.026 |
| 20 | 0.0011 | 0.005 | 0.35 | 0.022 | 0.011 | 0.003 | 0.0020 | 0.0017 | 0.035 |
| 21 | 0.0022 | 0.003 | 0.30 | 0.010 | 0.019 | 0.008 | 0.0028 | 0.0022 | 0.008 |
| 22 | 0.0014 | 0.004 | 0.24 | 0.010 | 0.022 | 0.004 | 0.0022 | 0.0018 | 0.031 |
| 23 | 0.0018 | 0.005 | 0.18 | 0.009 | 0.015 | 0.002 | 0.0023 | 0.0016 | 0.042 |
| 24 | 0.0010 | 0.003 | 0.21 | 0.013 | 0.014 | 0.004 | 0.0020 | 0.0013 | 0.030 |
| 25 | 0.0060 | 0.003 | 0.32 | 0.015 | 0.012 | 0.003 | 0.0034 | 0.0015 | 0.031 |
| 26 | 0.0022 | 0.003 | 0.35 | 0.015 | 0.008 | 0.012 | 0.0016 | 0.0032 | 0.001 |

TABLE 2

| No. | Hot-rolling heating conditions | | | | | | | | | Hot-rolling conditions | | |
|---|---|---|---|---|---|---|---|---|---|---|---|---|
| | Retained Temperature Range 1 | | Retained Temperature Range 2 | | Cooling rate from Retained Temperature Range 1 to Retained Temperature Range 2 (° C./sec.) | Retained Temperature Range 3 | | Hot-rolling coiling conditions | | Reduction ratio before temperature retention (%) | Retained temperature (° C.) | Retention time (min.) |
| | Temperature (° C.) | Time (min.) | Temperature (° C.) | Time (min.) | | Temperature (° C.) | Time (min.) | Coiling temperature (° C.) | Retention time (min.) | | | |
| 1 | 1100 | 250 | — | — | — | — | — | 650 | 10 | — | — | — |
| 2 | 1080 | 360 | 1150 | 15 | 1.5 | 1030 | 30 | 650 | 10 | — | — | — |
| 3 | 1080 | 360 | 1150 | 15 | 1.5 | 1030 | 30 | 650 | 10 | — | — | — |
| 4 | 1080 | 360 | 1150 | 15 | 1.5 | 1030 | 30 | 650 | 10 | — | — | — |
| 5 | 1080 | 360 | 1150 | 15 | 1.5 | 1030 | 30 | 730 | 100 | — | — | — |
| 6 | 1080 | 360 | 1150 | 15 | 1.5 | 1030 | 30 | 730 | 100 | — | — | — |
| 7 | 1080 | 360 | 1150 | 15 | 1.5 | 1030 | 30 | 730 | 100 | — | — | — |
| 8 | 1080 | 360 | 1150 | 15 | 1.5 | 1030 | 30 | 730 | 100 | 75 | 950 | 10 |
| 9 | 1100 | 250 | — | — | — | — | — | 650 | 10 | — | — | — |
| 10 | 1080 | 360 | 1150 | 15 | 1.5 | 1030 | 30 | 650 | 10 | — | — | — |
| 11 | 1080 | 360 | 1150 | 15 | 1.5 | 1030 | 30 | 650 | 10 | — | — | — |
| 12 | 1080 | 360 | 1150 | 15 | 1.5 | 1030 | 30 | 650 | 10 | — | — | — |
| 13 | 1080 | 360 | 1150 | 15 | 1.5 | 1030 | 30 | 730 | 100 | — | — | — |
| 14 | 1080 | 360 | 1150 | 15 | 1.5 | 1030 | 30 | 730 | 100 | — | — | — |
| 15 | 1080 | 360 | 1150 | 15 | 1.5 | 1030 | 30 | 730 | 100 | — | — | — |
| 16 | 1080 | 360 | 1150 | 15 | 1.5 | 1030 | 30 | 730 | 100 | 75 | 950 | 10 |
| 17 | 1100 | 250 | — | — | — | — | — | 650 | 10 | — | — | — |
| 18 | 1080 | 360 | 1150 | 15 | 1.5 | 1030 | 30 | 650 | 10 | — | — | — |
| 19 | 1080 | 360 | 1150 | 15 | 1.5 | 1030 | 30 | 650 | 10 | — | — | — |
| 20 | 1080 | 360 | 1150 | 15 | 1.5 | 1030 | 30 | 650 | 10 | — | — | — |
| 21 | 1080 | 360 | 1150 | 15 | 1.5 | 1030 | 30 | 730 | 100 | — | — | — |
| 22 | 1080 | 360 | 1150 | 15 | 1.5 | 1030 | 30 | 730 | 100 | — | — | — |
| 23 | 1080 | 360 | 1150 | 15 | 1.5 | 1030 | 30 | 730 | 100 | — | — | — |
| 24 | 1080 | 360 | 1150 | 15 | 1.5 | 1030 | 30 | 730 | 100 | 75 | 950 | 10 |
| 25 | 1100 | 250 | — | — | — | — | — | 650 | 10 | — | — | — |
| 26 | 1100 | 250 | — | — | — | — | — | 650 | 10 | — | — | — |

The symbol "—" shows that the condition was not applied.

TABLE 3

| No. | NasBN/NasAlN | NasBN/N | Average grain diameter (μm) in claim 7 | Proportion of fine precipitates in claim 7 | Mechanical properties | | | Aging properties | | Enameling properties | | Remarks |
|---|---|---|---|---|---|---|---|---|---|---|---|---|
| | | | | | YP (MPa) | TS (MPa) | EI (%) | AI (MPa) | Fish scale resistance | Adhesiveness (%) | Surface properties | |
| 1 | 5.2 | 0.43 | 0.02 | 90 | 186 | 316 | 54 | 30 | Δ | 95 | Δ | Invented examples |
| 2 | 3.3 | 0.20 | 0.09 | 10 | 375 | 523 | 33 | 50 | ○ | 92 | Δ | |
| 3 | 6.9 | 0.80 | 0.05 | 60 | 177 | 308 | 56 | 5 | ○ | 92 | Δ | |
| 4 | 12 | 0.48 | 0.05 | 70 | 251 | 385 | 48 | 30 | ○ | 93 | Δ | |
| 5 | 14 | 0.52 | 0.07 | 20 | 217 | 348 | 51 | 5 | ○ | 90 | ○ | |
| 6 | 8.8 | 0.90 | 0.10 | 7 | 200 | 330 | 50 | 1 | ○ | 94 | ○ | |

TABLE 3-continued

| No. | NasBN/ NasAlN | NasBN/N | Average grain diameter (μm) in claim 7 | Proportion of fine precipitates in claim 7 | Mechanical properties YP (MPa) | TS (MPa) | EI (%) | Aging properties AI (MPa) | Fish scale resistance | Enameling properties Adhesiveness (%) | Surface properties | Remarks |
|---|---|---|---|---|---|---|---|---|---|---|---|---|
| 7 | 16 | 0.33 | 0.12 | 8 | 295 | 435 | 25 | 20 | ○ | 90 | ○ | |
| 8 | 26 | 0.82 | 0.14 | 8 | 339 | 477 | 39 | 2 | ○ | 100 | ◎ | |
| 9 | 6.3 | 0.45 | 0.05 | 20 | 204 | 335 | 52 | 2 | ○ | 96 | ○ | |
| 10 | 6.8 | 0.45 | 0.24 | 5 | 160 | 291 | 60 | 2 | ○ | 98 | ○ | |
| 11 | 6.8 | 1.00 | 0.19 | 40 | 209 | 341 | 52 | 0 | ◎ | 96 | ○ | |
| 12 | 21 | 0.37 | 0.24 | 15 | 171 | 301 | 55 | 10 | ◎ | 96 | ○ | |
| 13 | >50 | 0.90 | 0.12 | 80 | 220 | 353 | 49 | 1 | ◎ | 98 | ◎ | |
| 14 | 6.7 | 0.95 | 0.35 | 4 | 235 | 368 | 46 | 1 | ○ | 100 | ○ | |
| 15 | 24 | 0.77 | 0.28 | 2 | 190 | 320 | 54 | 3 | ◎ | 98 | ◎ | |
| 16 | >50 | 1.00 | 0.55 | 2 | 179 | 309 | 56 | 0 | ◎ | 100 | ◎ | |
| 17 | 4.1 | 0.22 | 0.08 | 30 | 171 | 302 | 59 | 10 | ○ | 95 | Δ | |
| 18 | 8.2 | 0.48 | 0.19 | 10 | 197 | 328 | 53 | 8 | ○ | 98 | ○ | |
| 19 | 6.7 | 0.74 | 0.06 | 50 | 166 | 296 | 56 | 6 | ○ | 98 | ○ | |
| 20 | >50 | 0.48 | 0.14 | 20 | 204 | 336 | 52 | 7 | ○ | 95 | ○ | |
| 21 | 25 | 1.00 | 0.06 | 20 | 205 | 336 | 45 | 0 | ○ | 100 | ○ | |
| 22 | 9.1 | 1.00 | 0.13 | 5 | 179 | 310 | 56 | 2 | ○ | 100 | ○ | |
| 23 | 14 | 0.41 | 0.31 | 5 | 181 | 312 | 57 | 5 | ◎ | 98 | ◎ | |
| 24 | >50 | 0.83 | 0.14 | 4 | 182 | 314 | 56 | 0 | ◎ | 100 | ◎ | |
| 25 | 5.3 | 0.20 | 0.04 | 80 | 222 | 322 | 53 | 70 | X | 85 | X | Comparative |
| 26 | 8.1 | 0.43 | 0.07 | 30 | 212 | 312 | 50 | 40 | X | 80 | X | examples |

◎: Very good,
○: Good,
Δ: Conventional level,
X: Poor

TABLE 4

| | Process steps | Conditions |
|---|---|---|
| 1 | Degreasing | Alkaline degreasing |
| 2 | Hot water rinse | |
| 3 | Water rinse | |
| 4 | Pickling | 15% $H_2SO_4$, 75° C. × 3 or 20 min. immersion |
| 5 | Water rinse | |
| 6 | Ni treatment | 2% $NiSO_4$, 70° C. × 3 min. immersion |
| 7 | Water rinse | |
| 8 | Neutralization | 2% $Na_2CO_3$, 75° C. × 5 min. immersion |
| 9 | Drying | |
| 10 | Glazing | Direct one-coat glaze, 100 μm in thickness |
| 11 | Drying | 160° C. × 10 min. |
| 12 | Baking | 840° C. × 3 min. |

The steel sheets according to the present invention have good workability and further satisfy all of the fish scale resistance, enamel adhesiveness and surface properties that are required of a steel sheet for vitreous enameling. In particular, the present invention makes a considerable cost reduction possible and has a great industrial significance, because it makes it viable to produce a steel sheet excellent in workability and aging resistance with decarbonization annealing or decarbonization and denitrification annealing that can be applied to a conventional high-oxygen steel without containing expensive elements such as Ti or Nb.

The invention claimed is:

1. A steel sheet for vitreous enameling excellent in workability, aging properties and enameling properties, the steel sheet comprising:

no more than 0.0025 mass percent carbon;

no more than 0.010 mass percent silicon;

from 0.1 to 0.5 mass percent manganese;

0.0005 to 0.0033 mass percent nitrogen;

from 0.60 times the amount of nitrogen to 0.0060 mass percent boron;

from 10 times the difference between the amount of boron and 11/14 times the amount of nitrogen, 10×(B−11/14×N), to 0.030 mass percent phosphorous;

no more than 0.030 mass percent sulfur;

no more than 0.010 mass percent aluminum;

0.005 to 0.0450 mass percent oxygen; and a balance of Fe and unavoidable impurities, wherein the steel sheet contains simple or compound nitrides, having a diameter of 0.02 to 0.50 μm, containing boron or aluminum, and having an average diameter of at least 0.080 μm, and the proportion of the number of the nitrides of 0.050 pm or smaller in diameter to the total number of the nitrides is 10 percent or less, wherein the ratio of the amount of nitrogen in the steel sheet existing as boron nitride, BN, to the amount of nitrogen in the steel sheet existing as aluminum nitride AlN, (the amount of N existing as BN)/(the amount of N existing as AlN), is ≧10.0; and the steel sheet further comprises a nickel plating on the steel sheet in an amount of about 0.01 to 2 $g/m^2$.

2. The steel sheet for vitreous enameling according to claim 1, wherein the steel sheet further comprises one or more of niobium, vanadium, titanium, nickel, chromium, selenium, arsenic, tantalum, tungsten, molybdenum, and tin, each in an amount of no more than 0.030 mass percent.

3. A method for producing a steel sheet for vitreous enameling excellent in workability, aging properties and enameling properties and enameling properties characterized by:

retaining a slab containing the components according to claim 1, in the temperature range from 900 to 1,100° C. (Retained Temperature Range 1) for 300 minutes or longer before commencing hot rolling;

thereafter retaining it in a temperature range not less than 50° C. higher than said retained temperature (Retained Temperature 2) for 10 to 30 minutes;

then cooling it to a temperature range not less than 50° C. lower than said retained temperature (Retained Temperature 3) at a cooling rate of 2° C./sec. or less;

retaining it in said retained Temperature 3 for 10 minutes or longer; and thereafter commencing hot rolling.

4. A method for producing a steel sheet for vitreous enameling excellent in workability, aging properties and enameling properties and enameling properties according to claim 3, wherein hot-rolling is controlled under the condition of the time period from the time when the coiling of a hot-rolled steel sheet terminates at a temperature of 700 to 750° C. in a hot-rolling process to the time when the temperature of said steel sheet reaches 550° C. or lower for 20 minutes or longer.

5. A method for producing a steel sheet for vitreous enameling excellent in workability, aging properties and enameling properties and enameling properties according to claim 3, wherein the hot-rolled steel sheet is retained in the temperature range from 900 to 1,200° C. for 2 minutes or longer with the temperature of said steel sheet not lowered to 900° C. or lower when the reduction ratio reaches 50% or more after commencing hot-rolling, and thereafter hot-rolling is commenced again.

* * * * *